US006975413B1

(12) United States Patent
Sasaoka

(10) Patent No.: US 6,975,413 B1
(45) Date of Patent: Dec. 13, 2005

(54) IMAGE FORMING APPARATUS AND SHEET SUPPLY UNIT FOR USE IN THE SAME

(75) Inventor: Yoshimasa Sasaoka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 887 days.

(21) Appl. No.: 09/721,770

(22) Filed: Nov. 27, 2000

(30) Foreign Application Priority Data

Nov. 30, 1999 (JP) ..... 11-341201

(51) Int. Cl.[7] ..... B65H 5/00

(52) U.S. Cl. ..... 358/1.12; 271/3.14; 271/8.1; 271/9.04; 399/388; 355/407; 101/37

(58) Field of Search ..... 358/1.1–1.9, 1.11–1.18; 271/3.01, 8.1, 3.06, 9.01, 3.09, 9.04, 3.14; 399/388; 355/407; 101/37

(56) References Cited

U.S. PATENT DOCUMENTS 5,289,236 A * 2/1994 Yoshino ..... 399/86

5,528,353 A * 6/1996 Ushio et al. ..... 399/364

FOREIGN PATENT DOCUMENTS

JP 3-182431 8/1991 ..... B65H 3/00

* cited by examiner

*Primary Examiner*—King Y. Poon
(74) *Attorney, Agent, or Firm*—Morgan, Lewis & Bockius LLP

(57) ABSTRACT

An image forming apparatus includes an image forming unit which accommodates an image forming module for forming an image on a recording sheet supplied, and a sheet supply unit disposed in parallel with the image forming unit, having one or plural sheet supply trays and feeding recording sheets stocked in the sheet supply trays to the image forming unit side. Sheet feeding paths from at least some of the sheet supply trays to the image forming unit are constructed as a bypass feeding path extending from the farther sides of the trays from the image forming unit, and a cover which is opened or closed and disposed to face the bypass feeding path is provided to the farther side of a unit case, accommodating the trays, from the image forming unit.

4 Claims, 7 Drawing Sheets

IMAGE FORMING APPARATUS AND SHEET SUPPLY UNIT FOR USE IN THE SAME

BACKGROUND OF THE INVENTION

1. Field of the Invention

The present invention relates to an image forming apparatus such as a copying machine or a printer, and particularly to improvements of such a type of image forming apparatus that a sheet supply unit is disposed in parallel with an image forming unit, and a sheet supply unit for use in the image forming apparatus.

2. Description of the Related Art

In connection with requirements of coloring, high-speed operation, increase of lifetime, etc. to image forming apparatuses, there has been recently such a tendency that some of image forming modules accommodated in an image forming unit, for example, a developing portion and a transfer portion are increased in size and the dimensional occupational ratio of these portions in the height direction of the image forming apparatus is increasing.

Under such a situation, the position at which an image transfer operation is carried out on a recording sheet by the image forming modules (hereinafter referred to as "transfer position") is shifted to a lower position, and thus a sheet feeding path must be located at a lower position of the apparatus.

Further, a sheet supply portion is ordinarily provided by using a space below the image forming modules. However, when the image forming modules themselves are large in size, it is impossible to dispose multiple sheet supply trays as the sheet supply portion below the image forming modules.

That is, if the multiple sheet supply trays are disposed as in the past regardless of the large size of the image forming modules, the relative position of the image forming modules is high and thus the height dimension of the image forming unit itself must be set to a large value. Therefore, there occurs such a problem that the operating portion of the image forming unit must be located at such a position that it is difficult for a user to manipulate the operating portion.

Conversely, when the operating portion of the image forming unit is located at a position which is suitable for user's manipulation, the space below the image forming modules is necessarily narrow, so that it is substantially difficult to dispose a large-capacity sheet supply tray as the sheet supply portion.

In order to solve these technical problems, there has been proposed a technique in which a sheet supply unit having multiple sheet supply trays accommodated therein is disposed at the side of the image forming unit so as to be in parallel with the image forming unit at the side thereof (see Japanese Laid-open Patent Application No. Hei-3-182431).

However, in this type of technique, recording sheets in the sheet supply trays are fed out in the same sheet feed-out direction from the image forming unit side. That is, the same sheet feed-out direction is set for all the sheet supply trays. Therefore, sheet feeding paths extending from the respective sheet supply trays are concentratively disposed at the image forming unit side of the respective sheet supply trays in the sheet supply unit, and then the recording sheets are fed out from the sheet feed-out port of the sheet supply unit to the image forming unit side.

In this case, from the viewpoint of reducing the size of the apparatus at maximum, the space between the sheet supply trays and the image forming unit side wall surface of the sheet supply unit is originally set to be narrow, and thus if the sheet feeding paths from the respective sheet supply units are concentratively disposed, not only a mechanism for jam clearance in the sheet feeding paths is more complicated, but also an operation for the jam clearance is more cumbersome.

In order to solve this technical problem, it may be considered that the sheet supply unit is moved away from the image forming unit in the jam clearance process or the like to ensure a working space for the jam clearance or the like. However, from the viewpoint of workability of the jam clearance, it is not preferable that the sheet supply unit having a large weight is moved every time the jam clearance is carried out.

SUMMARY OF THE INVENTION

The present invention has been made in view of the above circumstances, and provides an image forming apparatus which is originally equipped with a sheet supply unit and can easily perform the jam clearance in the sheet supply unit, and a sheet supply unit for use in the image forming apparatus.

According to an aspect of the present invention, the image forming apparatus has an image forming unit which accommodates an image forming module for forming an image on a recording sheet supplied thereto and a sheet supply unit being disposed in parallel with the image forming unit. The sheet supplying unit has one or plural sheet supply trays and a unit case accommodating the trays, and feeds recording sheets stocked in the sheet supply trays to the image forming unit. Sheet feeding paths from at least some of the sheet supply trays to the image forming unit are constructed as a bypass feeding path extending from the farther sides of the sheet supply trays from the image forming unit, and a cover which is opened or closed and disposed to face the bypass feeding path is provided to the farther side of the unit case from the image forming unit.

Another aspect of the present invention provides a sheet supply unit for use in an image forming apparatus having an image forming unit which accommodates an image forming module for forming an image on a recording sheet supplied thereto. The sheet supply unit is disposed in parallel with the image forming unit and feeds to the image forming unit recording sheets stocked in one or plural sheet supply trays. The sheet supply unit has a unit case which accommodates the one or plural sheet supply trays, sheet feeding paths from at least some of the sheet supply trays to the image forming unit, which paths are constructed as a bypass feeding path extending from the farther sides of the sheet supply trays from the image forming unit, and a cover which is opened or closed and disposed to face the bypass feeding path is provided to the farther side of the unit case from the image forming unit.

According to further aspect of the present invention, an image forming apparatus has a sheet supply unit which has one or plural sheet supply trays and feeds recording sheets stocked in the sheet supply trays to the outside, and an image forming unit which is disposed in parallel with the sheet supply unit and accommodates an image forming module for forming an image only on a recording sheet supplied from an external sheet supply source containing at least the sheet supply unit.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

Figure 1:
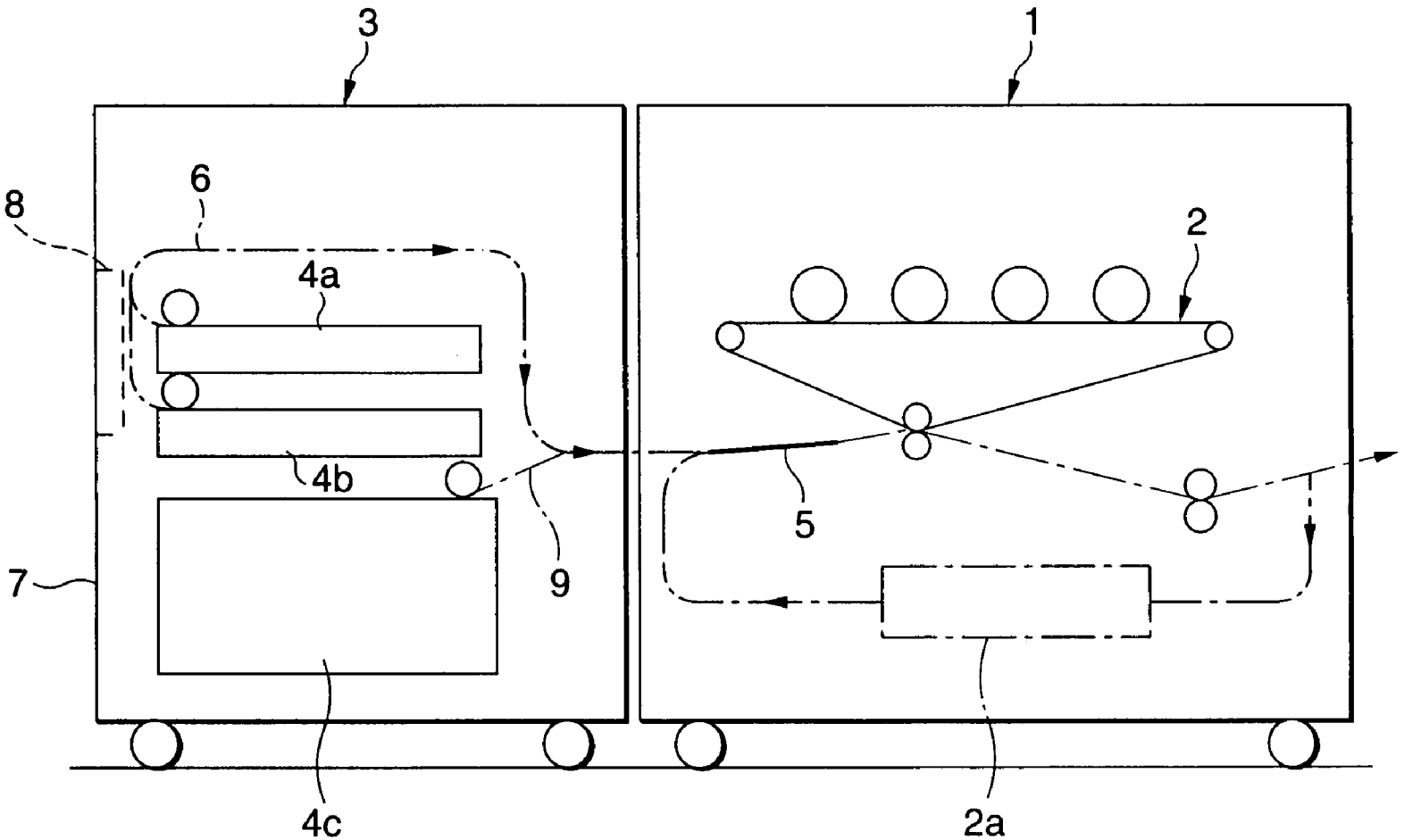
FIG. 1 schematically shows an image forming apparatus and a sheet supply unit used in the image forming apparatus according to the present invention.

The basic configuration of the image forming apparatus according to the present invention is explained based on the drawings. As shown in FIG. 1, an image forming apparatus includes an image forming unit 1 in which an image forming module 2 for forming an image on a recording sheet 5 supplied is accommodated, and a sheet supply unit 3 which is disposed in parallel with the image forming unit 1, has one or plural sheet supply trays 4 (for example, 4*a* to 4*c*) and feeds out recording sheets 5 stocked in the sheet supply trays 4 to the image forming unit 1 side. Sheet feeding paths from at least some of the sheet supply trays 4 (for example, 4*a*, 4*b*) are constructed as a bypass feeding path 6 extending from the opposite side to the image forming unit 1 in the sheet supply unit 3, and an open/close cover 8 which is opened/closed so as to face the bypass feeding path 6 is provided to a unit case 7 located at the opposite side to the image forming unit 1.

In the image forming apparatus thus constructed, the image forming module 2 is not limited to an intermediate transfer type tandem module as shown in FIG. 1, but contains various types of modules.

Particularly in the case of an image forming module 2 for carrying out both-side transfer or multiplex transfer on a recording sheet 5, the image forming apparatus is further provided with a sheet returning feeding mechanism 2*a* for directly returning a recording sheet 5 having an image formed on one side thereof to the transfer portion again or returning the recording sheet 5 to the transfer portion again while the recording sheet 5 is inverted.

Further, the bypass feeding path 6 may be provided to at least some of the sheet supply trays 4 (for example, 4*a*, 4*b*), however, it may be provided to all the sheet supply trays 4. In FIG. 1, the bypass feeding path 6 is guided from the side of the sheet supply tray 4 through an upper space to the image forming unit 1, however, the present invention is not limited to this configuration. For example, the bypass feeding path 6 may be guided from the side of the sheet supply tray 4 through a lower space to the image forming unit 1.

Still further, any member may be used as the open/close cover 8 insofar as it is opened/closed so as to face the bypass feeding path 6. However, from the viewpoint of keeping excellent the workability of the jam clearance at the bypass feeding path 6 when the open/close cover 8 is opened, it is preferable that the open/close cover 8 has one part of a feeding member (not shown) which is constructed by a pair of parts and provided to the bypass feeding path 6, and the nip state of the paired parts of the feeding member is released when the open/close cover 8 is opened.

In the case where the bypass feeding path 6 is provided to some of the sheet supply trays 4 (4*a*, 4*b*), a sheet feeding path from at least some of the sheet supply trays (for example, 4*c*) is constructed as a direct-coupled feeding path 9 extending from the image forming unit 1 side in the sheet supply unit 3.

In this case, the sheet feeding paths of two systems, that is, the bypass feeding path 6 and the direct-coupled feeding path 9 are provided, however, this design is preferable because if a sheet supply tray 4 (for example, 4*c*) connected to the direct-coupled feeding path 9 is used for special sheets having high flexural rigidity such as coated paper or heavy weight paper, deformation or jam due to feeding of the recording sheet 5 can be effectively prevented.

Further, the present invention targets not only the image forming apparatus, but also the sheet supply unit 3 itself.

In this case, as shown in FIG. 1, a sheet supply unit 3 of the present invention is used in an image forming apparatus having an image forming unit 1 in which an image forming module 2 for forming an image on a recording sheet 5 supplied thereto is accommodated, and it is disposed in parallel with the image forming unit 1 and serves to feed out to the image forming unit 1 recording sheets 5 stocked in one or plural sheet supply trays 4 (for example, 4*a* to 4*c*). Sheet feeding paths from at least some of the sheet supply trays 4 (4*a*, 4*b*) are constructed as a bypass feeding path 6 extending from the opposite side to the image forming unit 1, and an open/close cover 8 which is opened/closed so as to face the bypass feeding path 6 is provided to a unit case 7 located at the opposite side to the image forming unit 1.

When an image forming module 2 is required to be formed in higher design level in connection with various requirements of coloring, high-functionality, etc., as shown in FIG. 1, the image forming apparatus is preferably equipped with a sheet supply unit 3 which has one or plural sheet supply trays 4 and serves to feed out recording sheets 5 stocked in the sheet supply trays 4 to the outside, and an image forming unit 1 which is disposed in parallel with the sheet supply unit 3 and contains an image forming module 2 for forming an image on only a recording sheet 5 supplied from an external sheet supply source containing at least the sheet supply unit 3.

In this case, the number of the sheet supply unit 3 is not limited to one, and plural sheet supply units 3 may be provided in parallel with one another. Any unit may be used as the image forming unit 1 insofar as it has no sheet supply source therein and forms an image on only a recording sheet 5 supplied from an external sheet supply source (containing a manual supply tray of the image forming unit, for example) containing at least the sheet supply unit 3.

Preferred embodiments according to the present invention will be described hereunder with reference to the accompanying drawings.

Figure 2:
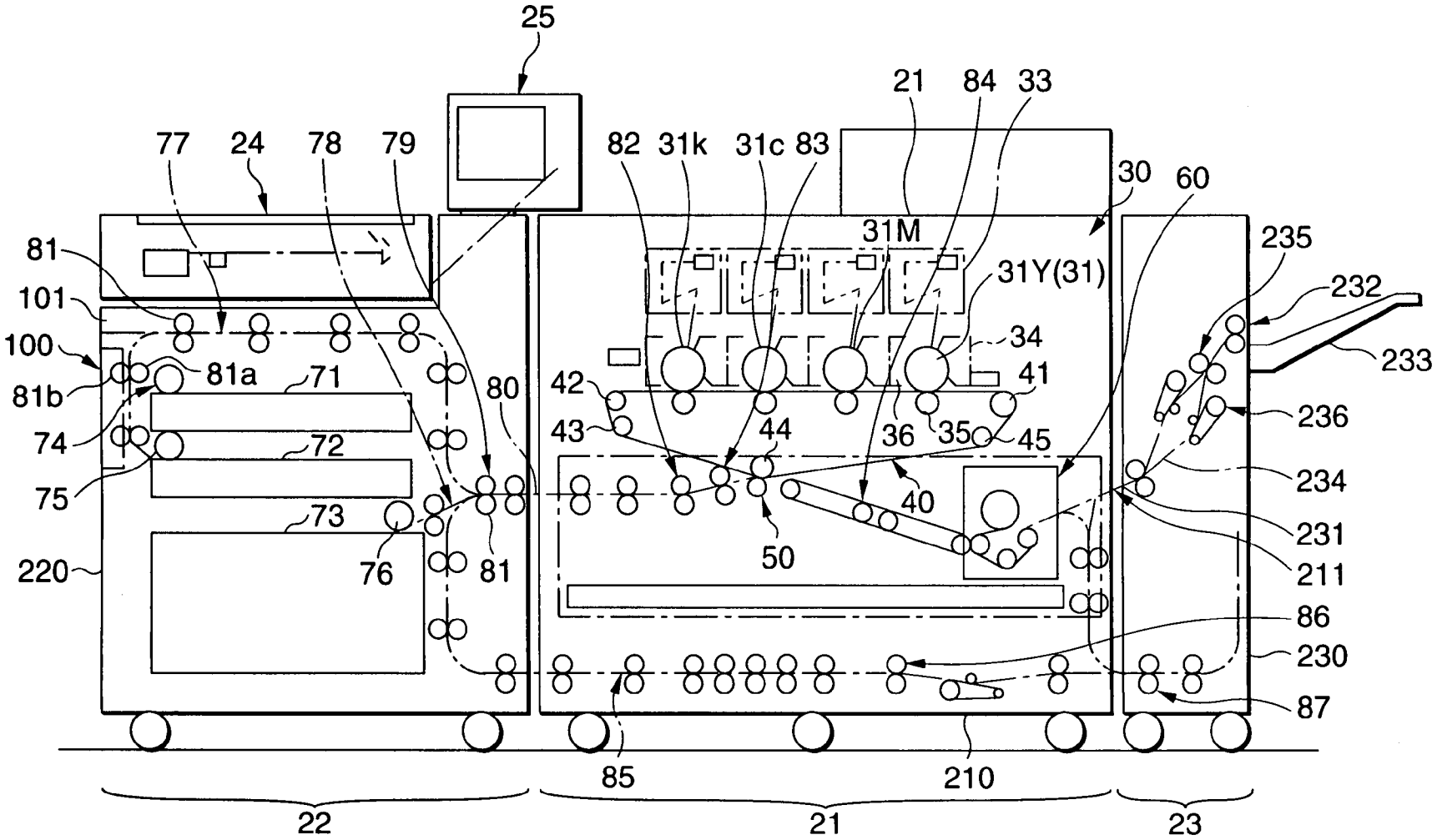
FIG. 2 shows the overall construction of the image forming apparatus according to the present invention.

FIG. 2 shows an embodiment of an image forming apparatus to which the present invention is applied.

In FIG. 2, the image forming apparatus according to this embodiment uses a so-called tandem type intermediate transfer system, and it includes an image forming unit 21 in which an image forming module 30 is accommodated, a sheet supply unit 22 which is disposed in parallel with the image forming unit 21 and supplies recording sheets (not shown) to the image forming unit 21, and a after-treatment unit 23 which is disposed in parallel with the image forming unit 21 and conducts a after-treatment on a recording sheet on which an image is formed in the image forming unit 21.

In this embodiment, the image forming unit 21 contains an image forming module 30 for forming toner images of respective color components (yellow (Y), magenta (M), cyan (C), black (K)) by using the electrophotographic system. The image forming module 30 is designed so that photosensitive drums 31 for forming and carrying toner images of respective color components (specifically, 31Y, 31M, 31C, 31K) are disposed in parallel with one another, the color component toner images formed on the photosensitive drums 31 are successively primarily transferred to an intermediate transfer belt 40 one by one, these color component toner images on the intermediate transfer belt 40 are secondly transferred on a recording sheet supplied from the sheet supply unit 22 by a secondary transfer roll 50, and then the recording sheet having these color component toner images is guided to a fixing unit 60.

In this embodiment, around each photosensitive drum 31 are successively disposed various devices for electrophotography such as a uniform charger (not shown) for charging the photosensitive drum 31, a laser exposure 33 for writing an electrostatic latent image on the photosensitive rum 31, a developer 34 which is filled with each color component toner and visualized the electrostatic latent image on the photosensitive drum 31 with the toner, a primary transfer roll 35 for transferring each color component toner image on the photosensitive drum 31 to the intermediate transfer belt 40, and a cleaner 36 for removing the residual toner on the photosensitive drum 31.

The intermediate transfer belt 40 is circulatively fed while suspended among tension rolls 41 to 45 (in this embodiment, five rolls). For example, the tension roll 41 is set as a driving roll, and the other tension rolls 42 to 45 are set as driven rolls. Further, any one of the tension rolls 42 to 45, for example, the tension roll 43 is set to function as a tension roll for applying tension to the intermediate transfer belt 40.

In this embodiment, the site of the intermediate transfer belt 40 which faces the tension roll 44 is set as a secondary transfer site. The secondary transfer roll 50 is disposed so as to contact the surface side of the secondary transfer site of the intermediate transfer belt 40, and a transfer bias is applied to the gap between the secondary transfer roll 50 and the tension roll 44 (functioning as a backup roll) facing the secondary transfer roll 50.

Figure 3:
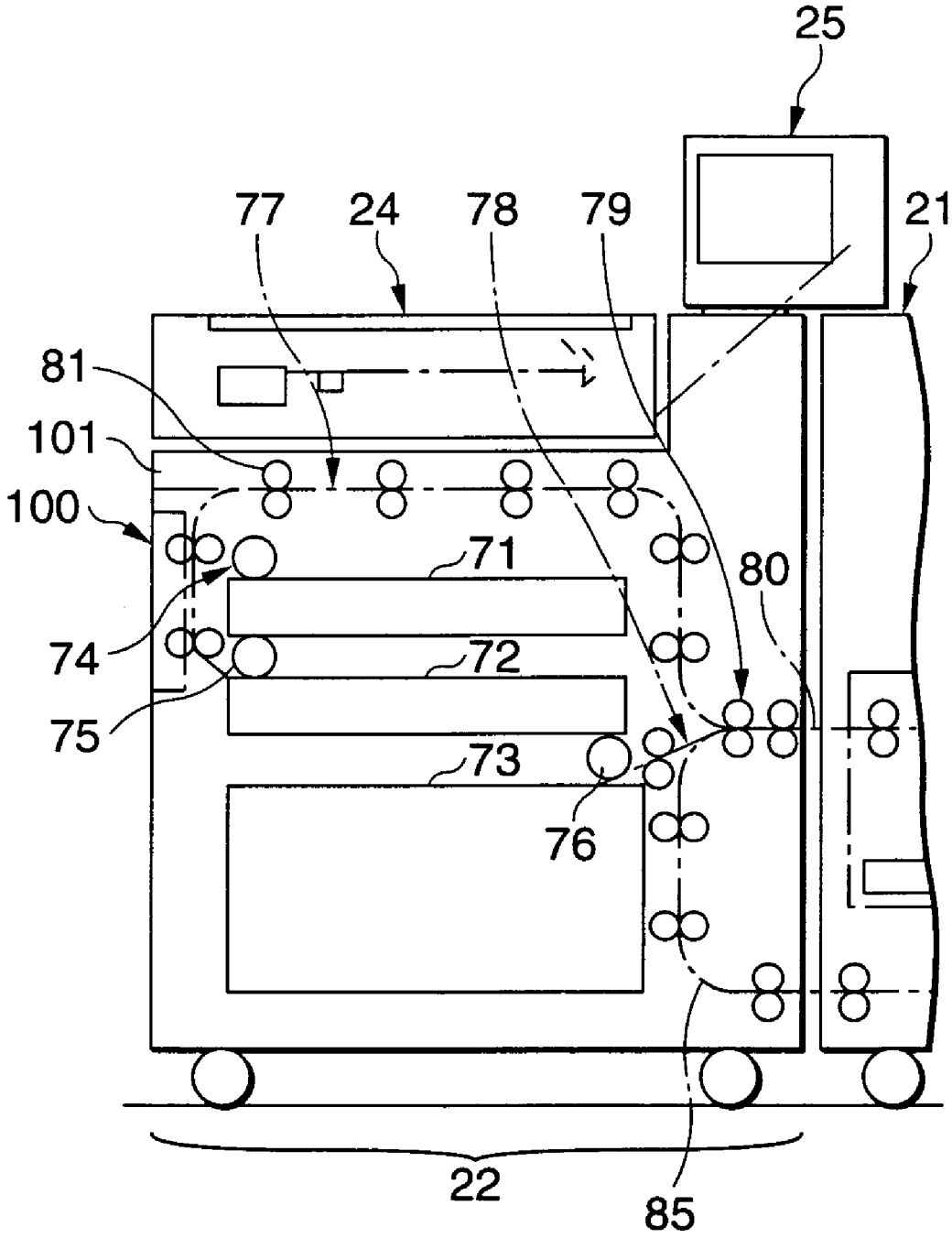
FIG. 3 is a diagram showing the details of the sheet supply unit according to the present invention.

Further, in this embodiment, the sheet supply unit 22 has multiple sheet supply trays 71 to 73 particularly as shown in FIG. 3. Recording sheets of plain paper which are different in size are stocked in the sheet supply trays 71, 72, and special sheets containing recording sheets having high flexural rigidity such as coated paper, heavy weight paper are stocked in the lowermost, large-capacity sheet supply tray 73.

Particularly, in this embodiment, the sheet supply trays 71, 72 have field rolls 74, 75 at the opposite side to the image forming unit 21, and the sheet supply tray 73 has a field roll 76 at the image forming unit 21 side.

The sheet feeding path from the sheet supply trays 71, 72 is constructed as a bypass feeding path 77 which extends upwardly from the opposite side of the sheet supply unit 22 to the image forming unit 21 through an upper space toward the image forming unit 21, and then extends downwardly.

On the other hand, the sheet feeding path from the sheet supply tray 73 is constructed as a direct-coupled feeding path 78 which approximately linearly extends to the image forming unit 21 side. The direct-coupled feeding path 78 and the bypass feeding path 77 intercommunicate with a confluent feeding path 79 to feed out the recording sheet from a feed-out port 80 to the image forming unit 21 side.

Further, plural feeding rolls 81 which are assembled as pairs are provided at predetermined intervals in the bypass feeding path 77, the direct-coupled feeding path 78 and the confluent feeding path 79 of the sheet supply unit 22.

Figure 4:
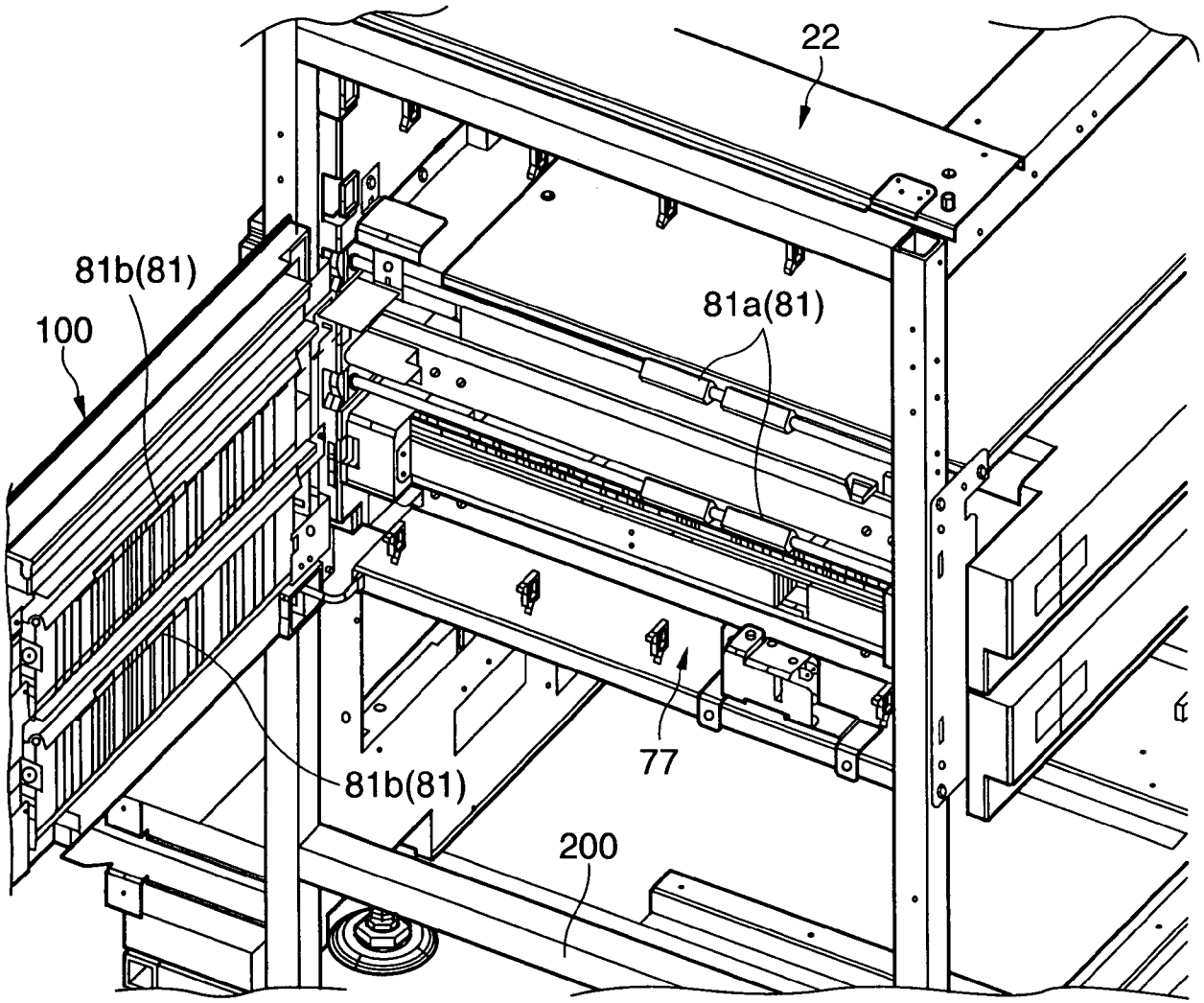
FIG. 4 is a diagram showing the structure of a bypass feeding path around an open/close cover according to the present invention.

Particularly, a cover 100 which is opened/closed so as to face the bypass feeding path 77 is provided at the opposite side of a unit case 220 of the sheet supply unit 22 to the image forming unit 21. As shown in FIG. 4, the cover 100 is designed to be rotatable with the inner site of the unit case 220 as a rotational supporting point, and freely rotatably holds a driven roll 81*b* of paired feeding rolls 81 (81*a*, 81*b*). When the cover 100 is opened, the driving roll 81*a* and the driven roll 81*b* of the feeding roll 81 are disposed separately from each other.

In this embodiment, a link feeding path 101 extending horizontally to the opposite side to the image forming unit 21 is formed at the horizontal feeding path portion of the bypass feeding path 77 of the sheet supply unit 22. For example in such a case that another sheet supply unit (not shown) is disposed so as to be adjacent to the sheet supply unit 22, the link feeding path 101 serves as a feeding path for receiving a recording sheet supplied from the other sheet supply unit and guiding it to the bypass feeding path 77 or as a manual recording sheet insertion portion of the sheet supply unit 22.

In this embodiment, an image reading unit 24 and a user operating portion 25 are disposed above the sheet supply unit 22. The image reading unit 24 optically reads an image of an original put on an original table, and it is constructed by a light source, a reflection mirror, an imaging lens, a CCD sensor, etc., for example.

Further, in this embodiment, the after-treatment unit 23 has an inlet opening 231 which is formed in a unit case 230 so as to face a recording sheet discharging port 211 formed in the unit case 210 of the image forming unit 21, and also an outlet opening 232 at the opposite side of the unit case 230 to the image forming unit 21.

In this embodiment, the inlet opening 231 is provided at a predetermined position at the lower half portion of the after-treatment unit 23 (for example, at a height of about 300 to 450 mm), and the outlet opening 232 is provided at a predetermined position of the upper half portion of the after-treatment unit 23 (for example, at a height of about 750 mm to 850 mm). A sheet discharge tray 233 is secured to the unit case 230 so as to face the outlet opening 232. A slant feeding path 234 extending in a slant direction is provided between the inlet opening 231 and the outlet opening 232. The slant feeding path 234 is branched to two paths at some midpoint, and curl correcting devices 235, 236 for up-curl correction and down-curl correction are provided in the branch feeding paths, respectively.

The sheet feeding path in the image forming unit 21 has not only a path along which a recording sheet supplied from the sheet supply unit 22 is guided to the secondary transfer site, passed through the fixer 60 and then discharged to the after-treatment unit 23, but also a path in which the recording sheet fed from the fixer 60 is inverted and then returned to the secondary transfer site.

Here, in this embodiment, the side edge of the recording sheet is set to a side initial position by the plural (for example, three) feeding slant rolls 82 which are respectively paired and disposed at the upstream side of the secondary transfer site. Thereafter, the recording sheet is fed to the secondary transfer site while arranged and positioned to a reference position by paired registration rolls 83 arranged in front of the secondary transfer site, and then the recording sheet after passed through the secondary transfer site is fed to the fixer 60 by a feeding belt 84, for example.

Further, a sheet return mechanism used in this embodiment is designed so that the recording sheet fed out from the fixer 60 is fed along a loop-type return path 85 by a proper number of feeding rolls 86. An inverting portion (constructed by using a lower space in the after-treatment unit 23 in this embodiment) 87 is provided at some midpoint of the return path 85, and the recording sheet is inverted through the inverting portion 87. A part of the return path 85 is constructed by using a space in the sheet supply unit 22 so as to intercommunicate with the confluent feeding path 79.

Next, the operation of the image forming apparatus of this embodiment will be described.

Assuming that a recording sheet is fed out from any one of the sheet supply trays 71 and 72 of the sheet supply unit 22, this recording sheet is passed through the bypass feeding path 77 and the confluent feeding path 79, fed out from the feed-out port 80 toward the image forming unit 21, and then fed through the feeding slant roll 82 and the registration roll 83 to the secondary transfer site.

Under this state, a color toner image formed by the image forming module 30 is transferred onto the recording sheet, and the recording sheet on which the image has been transferred is passed through the fixer 60 and then fed toward the after-treatment unit 23. In the after-treatment unit 23, the recording sheet is passed through the slant feeding path 234 and fed out. In this process, under the condition that the curl occurs in the recording sheet, the recording sheet is subjected to after-treatment (curl correction) of any one of the curl correcting devices 235 and 236, and then discharged to the sheet discharge tray 233.

Further, the recording sheet fed out from the sheet supply tray 73 is a special sheet such as a coated sheet, a heavy weight paper, however, it is fed to the secondary transfer site without paying attention to flexural deformation, jam, etc. because it is passed through the direct-coupled feeding path 78 and the confluent feeding path 79 and fed out from the feed-out port 80 toward the image forming unit 21.

In a case where the recording sheet jams just after it is fed out from the sheet supply tray 71 or 72, jam clearance is carried out as follows. Under the state that the cover 100 is kept open, it is sufficient to remove the recording sheet trapped in the bypass feeding path 77 just after it is fed out from the sheet supply tray 71 or 72. Further, in a case where the recording sheet jams at the sheet feeding path portion at the image forming unit 21 side of the sheet supply unit 22, the jam clearance can be easily carried out by providing a jam clearance mechanism as shown in FIG. 5.

Figure 5:
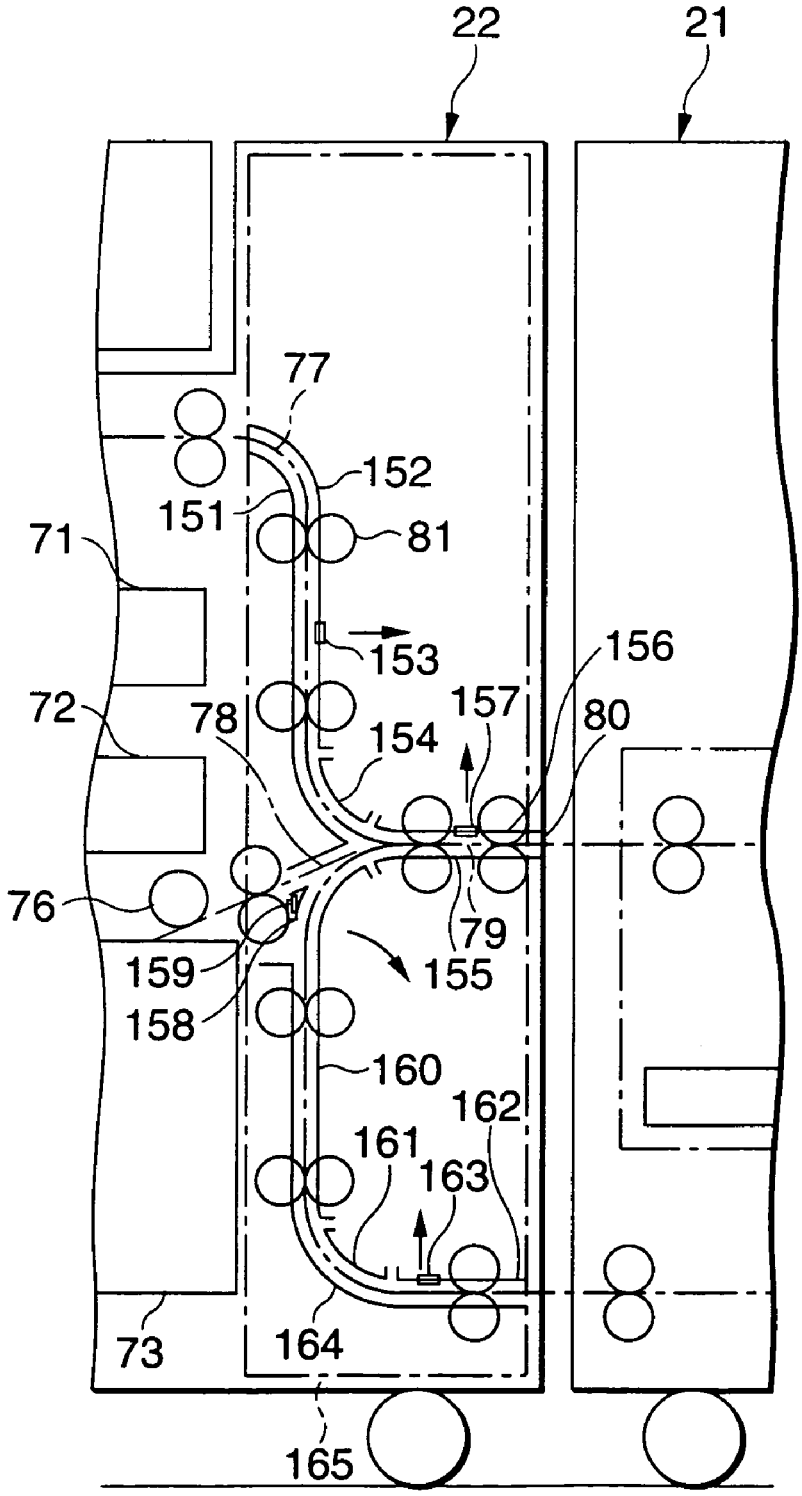
FIG. 5 shows an example of a jam clearance mechanism around the image forming unit side of the sheet supply unit according to the present invention.

In FIG. 5, the jam clearance mechanism is designed as follows. The lower right portion of the bypass feeding path 77 is comparted by an inside fixed guide chute 151, an outside movable guide chute 152 which is freely movable in the direction of an arrow by manipulating a thumbscrew 153 and an outside fixed guide chute 154, and the confluent feeding path 79 is comparted by a lower fixed guide chute 155 and an upper movable guide chute 156 which is freely movable in the direction of an arrow by manipulating a thumbscrew 157. Further, the direct-coupled feeding path 78 is comparted by a part of the inside fixed guide chute 151 and a lower movable guide chute 158 which is freely movable in the direction of an arrow by manipulating a thumbscrew 159, and a part of the return path 85 is comparted by an outside movable guide chute 160 which is movable integrally with the lower movable guide chute 158, an outside fixed guide chute 161, an upper movable guide chute 162 which is freely movable in the direction of an arrow by manipulating a thumbscrew 163, and an inside fixed guide chute 164. Reference numeral 165 represents an open/close door which is opened/closed forwardly in FIG. 5.

With the jam clearance mechanism, a recording sheet jamming at some midpoint of the sheet feeding path can be easily removed by moving a movable guide chute located at a place where the jam occurs in the sheet feeding path.

Here, the easiness of the jam clearance by the jam clearance mechanism according to this embodiment will be described on the basis of a comparison example of FIG. 6.

Figure 6:
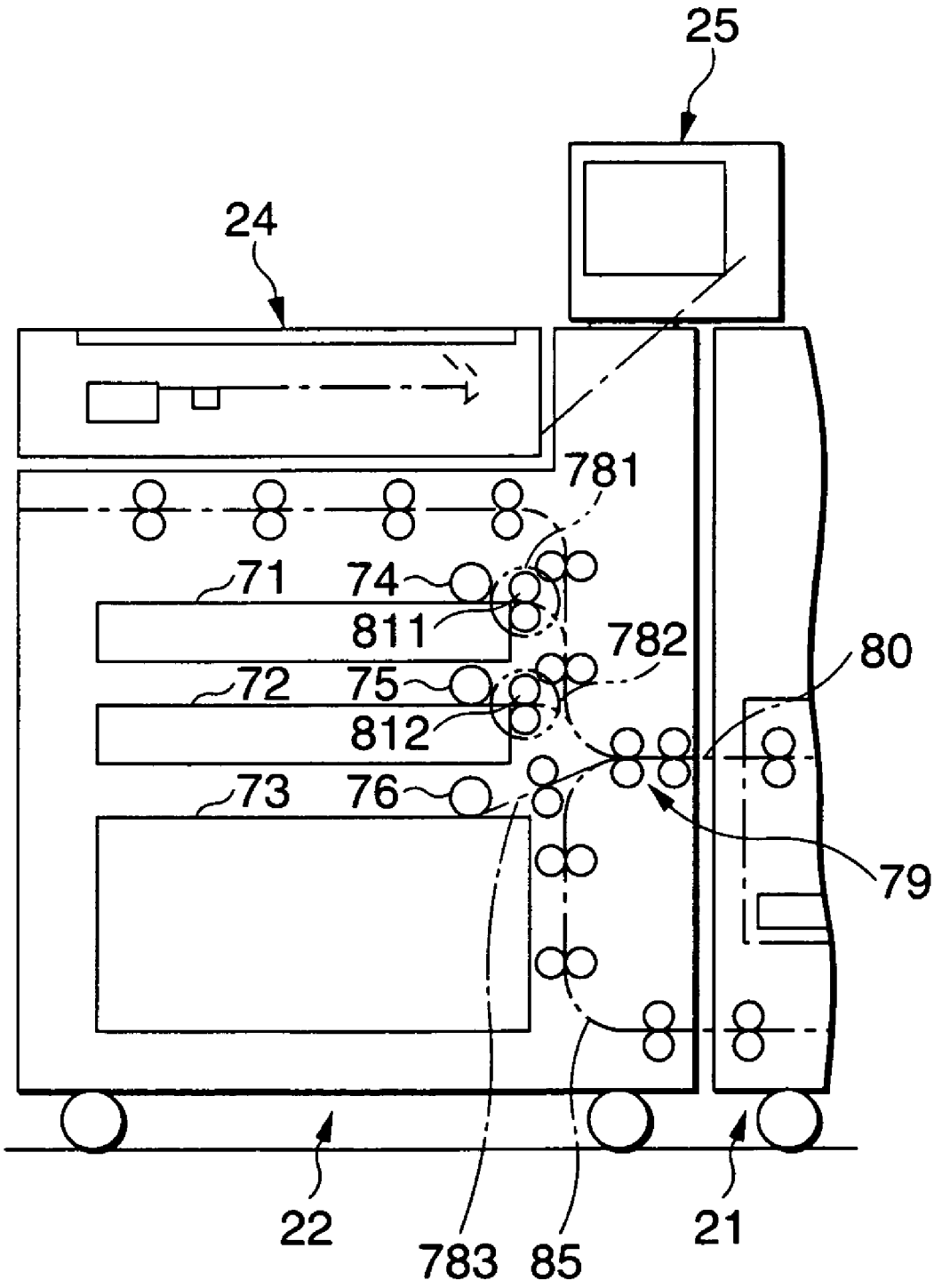
FIG. 6 shows a comparative example of the sheet supply unit.

The comparison example of FIG. 6 relates to an image forming apparatus in which the feed-out direction of recording sheets from sheet supply trays 71 to 73 is set to the image forming unit 21 side, and all the recording sheets are guided through the direct-coupled feeding paths 781 to 783 (783 corresponds to 78 in FIG. 5) to the confluent feeding path 79.

In this case, the direct-coupled feeding paths 781, 782 from the sheet supply trays 71, 72 are provided in addition to the jam clearance mechanism shown in FIG. 5. Therefore, an opening mechanism and feeding rolls 811, 812 must be added to the chute portions by which the direct-coupled feeding paths 781, 782 are comparted. Therefore, the chute construction is more complicated, and also the jam clearance space at the chute portion is extremely narrow, so that it is very difficult to carry out the jam clearance on the recording sheet just after fed out from the sheet supply tray 71 or 72.

In this embodiment, the direct-coupled feeding path 78 is used as the sheet feeding path from the sheet supply tray 73. However, in such a case that plain paper is used in the sheet supply tray 73, a bypass feeding path 77 extending from the opposite side to the image forming unit 21 may be provided for the sheet supply trays 71 to 73 as shown in FIG. 7.

Figure 7:
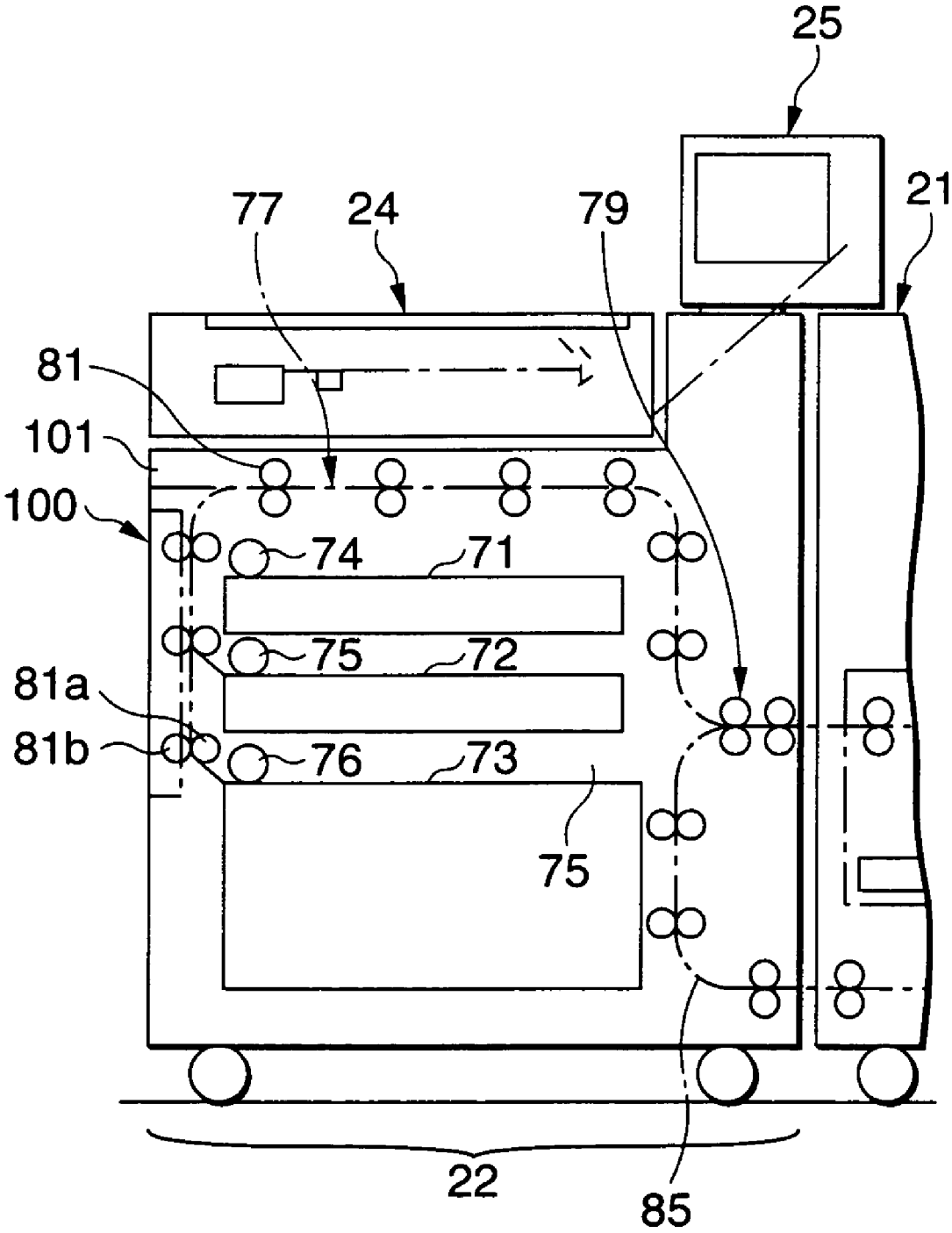
FIG. 7 shows a modification of the sheet supply unit of the present invention.

In this case, in order to keep the excellent workability of jam clearance when the recording sheet just after fed out from the sheet supply trays 71 to 73 jams, it is preferable to provide an open/close cover 100 over the whole site facing the opposite side to the image forming unit 21 of the bypass feeding path 77 as shown in FIG. 7.

As described above, according to the present invention, the present invention is based on the image forming apparatus equipped with the sheet supply unit, and at least the sheet feeding paths of some of the sheet supply trays are set as a bypass feeding path extending from the opposite side to the image forming unit, and an open/close cover for the jam clearance for the bypass feeding path is provided to the unit case located at the opposite side to the image forming unit. Therefore, the jam clearance at the recording sheet feed-out portions of at least the sheet supply trays which are linked to the bypass feeding path can be simply performed by opening the open/close cover. In addition, the crowding state of the sheet feeding paths in the vicinity of the image forming unit of the sheet supply unit can be moderated, so that the jam clearance at this place can be relatively readily performed, and the jam clearance in the sheet supply unit can be easily performed.

If all the sheet supply trays are accommodated at the sheet supply unit side arranged in parallel with the image forming unit, the image forming module in the image forming unit can be designed in higher level in accordance with various requirements such as coloring, high-speed operation and multi-functionality. Therefore, the high performance of the image forming apparatus can be easily implemented.

The entire disclosure of Japanese Patent Application No. 11-341201 filed on Nov. 30, 1999 including specification, claims, drawings and abstract is incorporated herein by reference in its entirety.

What is claimed is:

1. An image forming apparatus comprising:

an image forming unit which accommodates an image forming module for forming an image on a recording sheet supplied thereto; and a sheet supply unit being disposed in parallel with the image forming unit, the sheet supplying unit having one or plural sheet supply trays and a unit case accommodating the trays, and feeding recording sheets stocked in the sheet supply trays to the image forming unit, wherein sheet feeding paths from at least some of the sheet supply trays to the image forming unit are constructed as a bypass feeding path extending from the farther sides of the sheet supply trays from the image forming unit, and a cover which is opened or closed and disposed to face the bypass feeding path is provided to the father side of the unit case from the image forming unit.

2. The image forming apparatus as claimed in claim 1, wherein the cover has one of a pair of feeding members provided to the bypass feeding path, and the nip state between the feeding members is released when the cover is opened.

3. The image forming apparatus as claimed in claim 1, wherein the sheet feeding paths from at least some of the sheet supply trays to the image forming unit are constructed as a direct-coupled feeding path extending from the sides of the sheet feeding trays that are nearer to the image forming unit.

4. A sheet supply unit for use in an image forming apparatus having an image forming unit which accommodates an image forming module for forming an image on a recording sheet supplied thereto, the sheet supply unit being disposed in parallel with the image forming unit and feeding to the image forming unit recording sheets stocked in one or plural sheet supply trays, and the sheet supply unit comprising:

a unit case which accommodates the one or plural sheet supply trays;

sheet feeding paths from at least some of the sheet supply trays to the image forming unit, which paths are constructed as a bypass feeding path extending from the father sides of the sheet supply trays from the image forming unit; and a cover which is opened or closed and disposed to face the bypass feeding path is provided to the father side of the unit case from the image forming unit.

* * * * *